US005667392A

United States Patent [19]

Kocher et al.

[11] Patent Number: 5,667,392

[45] Date of Patent: *Sep. 16, 1997

[54] ELECTRICAL CONNECTOR WITH STABILIZED CONTACT

[75] Inventors: Timothy Lee Kocher, Camp Hill; William Edward Veith; Randolph Lee Buchter, both of Harrisburg, all of Pa.

[73] Assignee: The Whitaker Corporation, Wilmington, Del.

[ * ] Notice: The term of this patent shall not extend beyond the expiration date of Pat. No. 5,582,519.

[21] Appl. No.: 632,692

[22] Filed: Apr. 16, 1996

Related U.S. Application Data

[63] Continuation of Ser. No. 412,177, Mar. 28, 1995, abandoned.

[51] Int. Cl.[6] ..... H01R 13/40

[52] U.S. Cl. ..... 439/79; 439/733.1

[58] Field of Search ..... 439/79, 80, 83, 439/78, 733.1, 869

[56] References Cited

U.S. PATENT DOCUMENTS

| | | | |
|---|---|---|---|
| 4,092,622 | 5/1978 | Widemann et al. | 439/871 X |
| 4,384,754 | 5/1983 | Douty et al. . | |
| 4,632,475 | 12/1986 | Tomita . | |
| 4,715,819 | 12/1987 | Iwasa et al. . | |
| 4,813,881 | 3/1989 | Kirby | 439/733.1 X |
| 4,857,001 | 8/1989 | Nakano et al. | 439/733.1 X |
| 5,004,434 | 4/1991 | Aiello et al. . | |
| 5,263,882 | 11/1993 | Peterson | 439/869 X |
| 5,376,012 | 12/1994 | Clark | 439/80 |
| 5,458,426 | 10/1995 | Ito | 439/80 |
| 5,582,519 | 12/1996 | Buchter | 439/608 X |

OTHER PUBLICATIONS

Abstract and drawings Ser. No. 08/412,044 Mar. 28, 1995.

*Primary Examiner*—Allan N. Shoap
*Assistant Examiner*—Christopher J. McDonald

[57] ABSTRACT

A right angle electrical connector (20) includes a housing (22) having a mating face (24), an assembly face (26) opposed from the mating face (24) and adapted to receive at least one electrical contact (50) therein, and a third face (28); at least one contact-receiving passageway (30) extending from the assembly face (26) to the mating face (24), and a contact receiving slot (32) open to the third face (28) and to the assembly face (26). Each electrical contact (50) includes a first connecting portion (52) for electrical engagement with a complementary connector, a second connecting portion (54) extending from the third face (28) and outwardly from the housing (22) for electrical connection to an electrical article and a retention section (56) associated with a cooperable housing channel (36). The contact retention section (56) includes a barb (60) at a leading end thereof and a lance (62) at the rearward end thereof which cooperate to resist rearward and sideways movement of the contact 50 respectively after full assembly of the contact (50) into the contact-receiving passageway (30).

6 Claims, 5 Drawing Sheets

ELECTRICAL CONNECTOR WITH STABILIZED CONTACT

This application is a continuation of application Ser. No. 08/412,177 filed Mar. 28, 1995, now abandoned.

FIELD OF THE INVENTION

The present invention is directed to electrical connectors and in particular to right angle electrical connectors having substantially planar contacts.

BACKGROUND OF THE INVENTION

Right angle electrical connectors are often used in the electronic industry to connect daughter cards to mother boards or the like. In some applications the daughter card connectors are mounted along the edge of a board such that the mating portion of the connector housing extends outwardly from and also partially below the board. This arrangement is often used when components are to be added to both sides of the daughter card. Some of the electrical connectors or modules used in such interconnections may carry power and/or signal circuits and a ground circuit. Power and ground circuits in particular may be carried by flat blade like contacts, which are stamped from strips of metal.

To facilitate manufacturing and assembly of the connectors, it is generally desirable that the power as well as signal contacts used in the connectors be ones that can be press-fit into through-holes of a board thereby avoiding the extra steps needed for soldering the connections.

Furthermore for assuring reliability, it is desirable that the power contact connector or module be one that provides a plurality of current paths to the mating interface as well as to the traces on the circuit board.

SUMMARY OF THE INVENTION

The present invention is directed to a right angle electrical connector having a housing with a mating face adapted to mate with a complementary connector, an assembly face adapted to receive at least one electrical contact therein and a third face adapted for establishing electrical connection with a circuit board or complementary electrical article; and an electrical contact disposed in a contact-receiving passageway and having a first connecting portion exposed to the mating face for electrical engagement with the complementary connector and a second connecting portion extending from the third face of the housing and outwardly therefrom for electrical connection to the electrical article. The assembly face of the housing is opposed from the mating face thereof and the third face is at right angles to the mating face. The contact-receiving passageway further includes a contact-receiving slot open to the third face and to the assembly face.

The second connecting portion of the contact is at right angles to the first connecting portion. The contact also includes a retention section remote from and opposite to the second connecting portion and associated with a cooperable housing portion. The cooperable housing portion is opposite from the third face and defines a channel extending forwardly from the assembly face toward the mating face. The channel is adapted to receive the contact retention section thereinto when the contact is received in the assembly face of the housing. The contact retention section includes a barb at the leading end thereof receivable in the forward portion of the channel and is dimensioned to create an interference fit such that the contact resists rearward movement after full assembly into the housing.

In the preferred embodiment the contact retention section further includes an outwardly extending lance or alternatively an embossment, which is received in a cooperable portion of the housing channel to stabilize the contact against the opposite side wall of the passageway thereby stabilizing the contact in the housing. Additionally the body of the contact includes an embossment which extends outwardly from the surface of the intermediate contact body in the same direction as lance. The embossment assures that the contact body is positioned in the contact-receiving passageway against the sidewall proximate the mating face end of the passageway. By holding the contact securely against the sidewall of the contact-receiving passageway, alignment of the first connecting portion of the contact at the mating face is assured. Furthermore, the use of an embossment on the body allows the width of the passageway to be greater than the thickness of the contact thereby permitting the first connecting portion to move freely through the passageway thus avoiding damage to any plating thereon.

An advantage of the present invention is that it facilitates manufacturing and assembly of the connectors by providing a power or ground contact that is can be press-fit into through-holes of a board thereby avoiding the need to solder the terminal leads.

Furthermore the power contact is cost effective to manufacture since it is stamped from flat material. The contacts and connector of the present invention further provide a plurality of contact paths to the mating interface and to the circuit board traces.

The connector assembly of the present invention in addition allows the mating blade to overhang the circuit board while securely positioning the contact in the housing.

Embodiments of the present invention will now be described with reference to the following drawings.

DETAILED DESCRIPTION OF THE DRAWINGS

Figure 5:
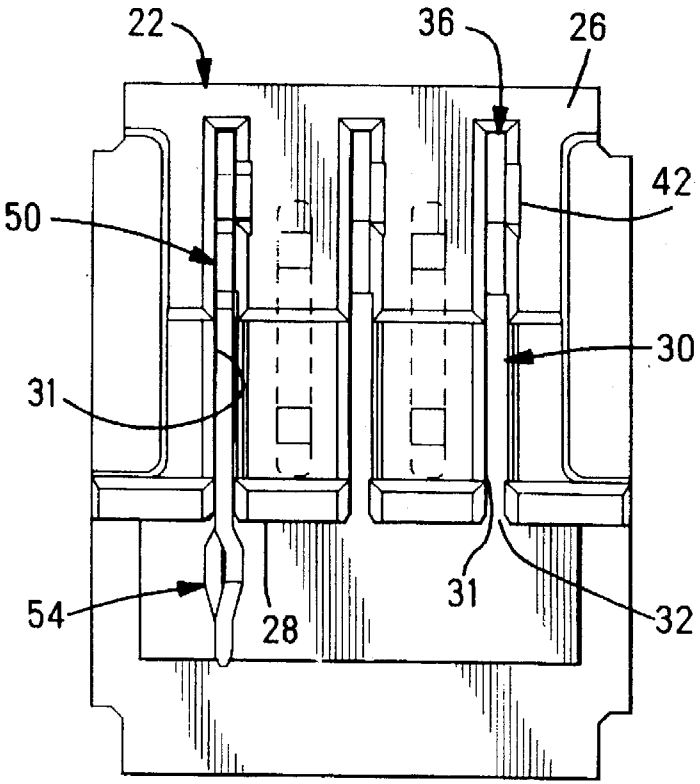
FIG. 5 is a flat plan view of the assembly face of the connector of FIG. 1.

Referring now to FIGS. 1 through 8, connector 20 includes a housing 22 having an electrical contact 50 disposed therein. The housing 22 has a mating face 24 adapted to mate with a complementary electrical connector such as connector 80 shown in FIG. 8, an assembly face 26 adapted to receive at least one electrical contact 50 therein and a third face 28 adapted for establishing electrical connection with a complementary electrical article such as circuit board 70 shown in FIG. 8. The assembly face 26 is opposed from the mating face 24 and the third face 28 is at right angles to the mating face 24. Housing 22 includes at least one contact-receiving passageway 30 extending from the assembly face 26 to the mating face 24. The passageway 30 further has a contact-receiving slot 32 open to the third face 28 and to the assembly face 26 as best seen in FIG. 5.

Figure 1:
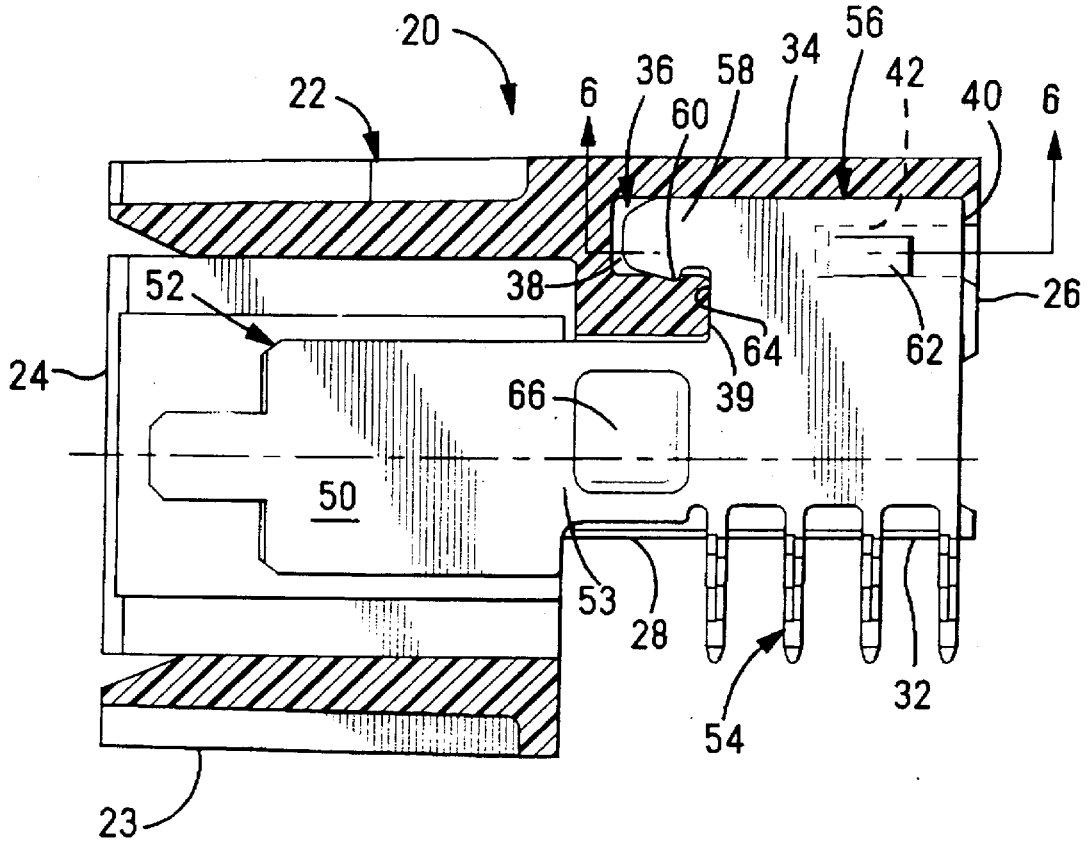
FIG. 1 is a cross-sectional view of the connector having an electrical contact made in accordance with the invention disposed within a contact-receiving passageway of the housing.
Figure 3:
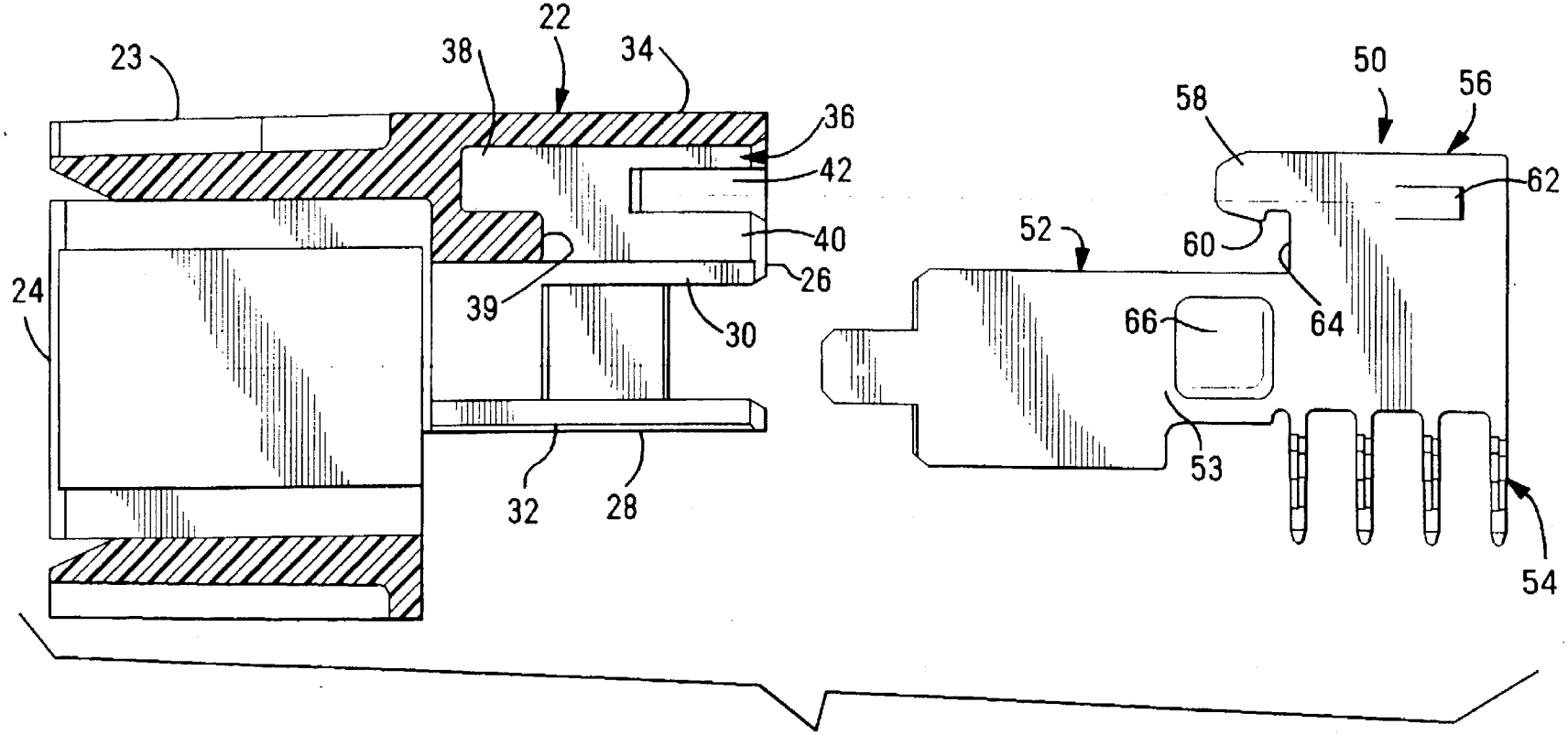
FIG. 3 is a view similar to that of FIG. 1 with the contact exploded from the housing.
Figure 4:
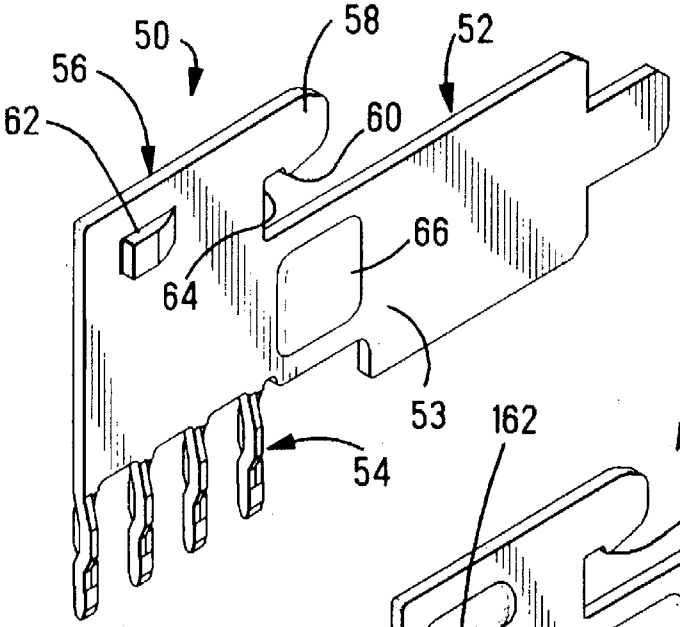
FIG. 4 is a perspective view of the contact of FIG. 1.

Electrical contact 50, as best seen in FIGS. 1, 3 and 4, includes a first connecting portion 52 exposed at the mating face 24 for an electrical engagement with complementary connector, a second connecting portion 54 being at right angles to the first connecting portion 52 and adapted for electrical connection to an electrical article and an intermediate body portion 53. In the preferred embodiment first connecting portion 42 is a blade and the second connecting portion 52 is a plurality of compliant tails, which can be press fit into respective through-holes of a circuit board. The compliant section of the contact tails may be of the ACTION PIN design available from AMP INCORPORATED, which can be press fit into position. It is to be understood that other press-fit or compliant tail designs may also be used as well as solder tails, if so desired.

In the preferred embodiment intermediate body portion 53 includes an embossment 66 which is used to position contact 50 against sidewall 31 within contact-receiving passageway 30 proximate the mating face end of the passageway 30. By holding the contact 50 securely against the sidewall 31 of the contact-receiving passageway 30, alignment of the first connecting portion 52 of the contact 50 at the mating face 24 is assured. Furthermore, the use of an embossment 66 on the body portion 53 allows the width of the passageway 30 to be greater than the thickness of the contact 50 thereby permitting the first connecting portion 52 to move freely through the passageway 30 during connector assembly, thus avoiding damage to any plating thereon.

Connector 50 further includes a retention section or arm 56 remote from and opposite the second connecting portion 52 and associated with a cooperable housing portion 34 when the contact 50 is assembled into passageway 30 via the assembly face 26. Cooperable housing portion 34 is opposite from the third face 28 and includes a respective contact-retention channel 36 in communication with a corresponding one of the contact-receiving passageways 30. The contact retention channels 36 extend forwardly into housing 22 from opening 40 on the assembly face 26 toward the mating face 24 and ending rearwardly thereof. Each retention channel 36 has a width corresponding generally to the thickness of the contact 50 so that channel 36 is adapted to receive a retention section 56 of contact 50. As can be seen in FIG. 3, the retention channel 36 of the housing further includes a shorter contact positioning channel 42 at the rearward end 40 thereof extending from the assembly face 26 toward the mating face 24 and into an adjacent sidewall 31 of contact-receiving passageway 30. Channel 42 is adapted to receive a cooperable portion of contact 50 as more fully explained below.

Figure 2:
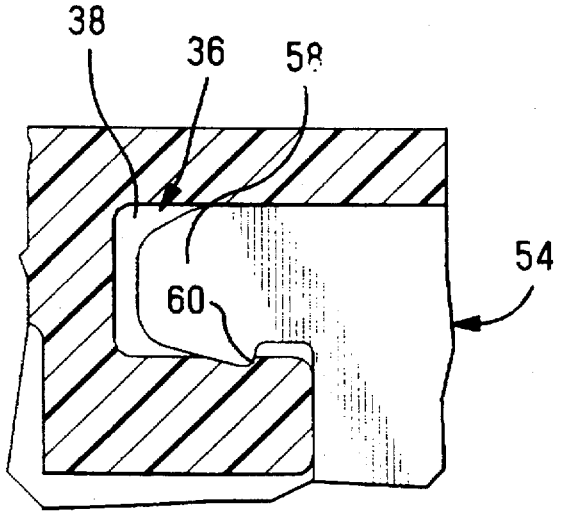
FIG. 2 is an enlarged fragmentary portion of FIG. 1 illustrating part of the retention features.

The contact retention section 56 of contact 50 has a barb 60 at the leading end 58 thereof which is receivable in the forward end 38 of the housing channel 36, the barb 60 being dimensioned to create an interference fit with the forward channel end 38 when the contact 50 is assembled into the housing 22. The barb 60 causes the contact 50 to resist rearward movement after full assembly of the contact 50 into the contact-receiving passageway 30. As can be seen in FIGS. 1 and 3, upon inserting the contact 50 into contact-receiving passageway 30 from assembly face 26, the first connecting portion, shown here as a blade 52, which is wider that the rearward portion of the housing 22, is received into and passes through slot 32 and enters the forward housing portion or shroud 23. The second connecting portion 54, shown in this example as four compliant contact sections or tails, is received in the respective slot 32 as the contact is moved forward into the housing. The retention section 56 enters the channel 36 until the contact stop surface 64 engages housing stop surface 39 within the housing 22. When fully inserted, the leading end 58 of retention section 56 is disposed in forward channel section 38 and embossment 66 holds the contact body 53 against sidewall 31. As seen in FIGS. 1 and 2 the retention barb 60 engages the interior portion of slot portion 38 to secure the contact 50 in the contact-receiving 30 and resist rearward movement of the contact 50 from the housing 22.

Figure 6:
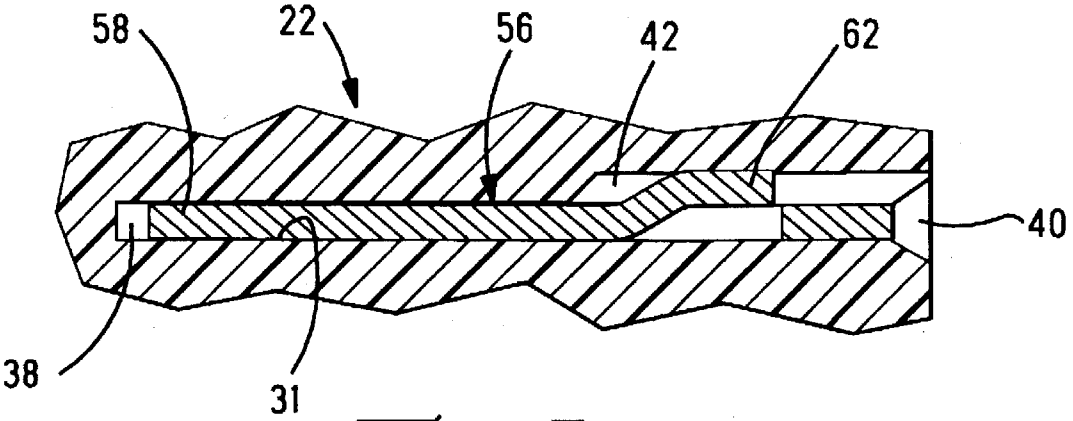
FIG. 6 is a sectional view taken along the line 6—6 of FIG. 1.
Figure 7:
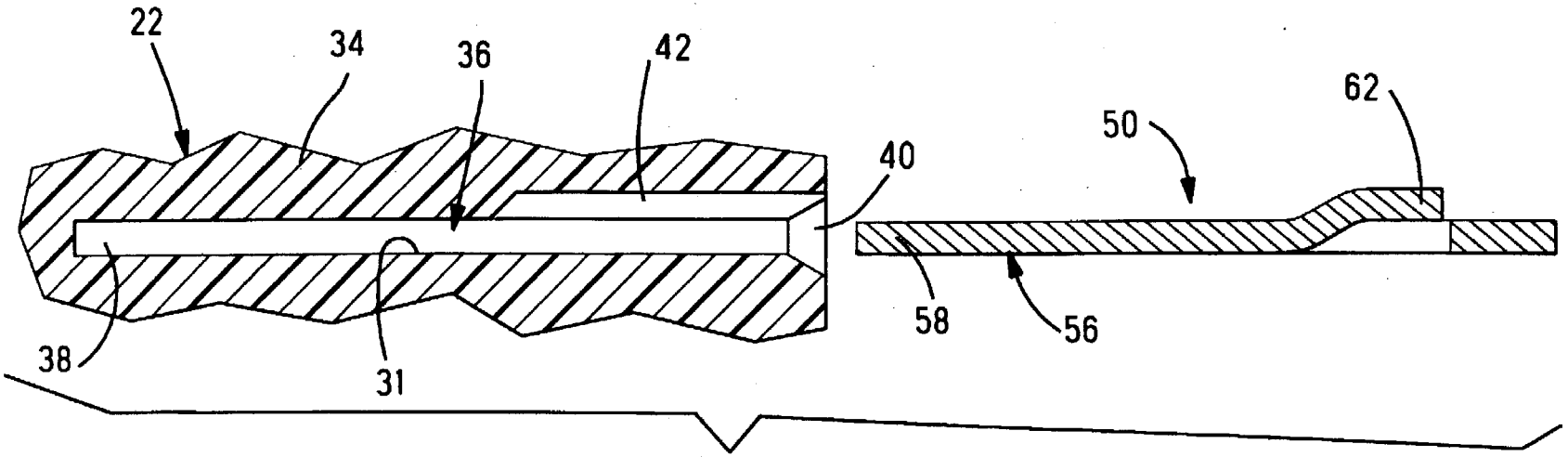
FIG. 7 is an exploded view of FIG. 6.
Figure 8:
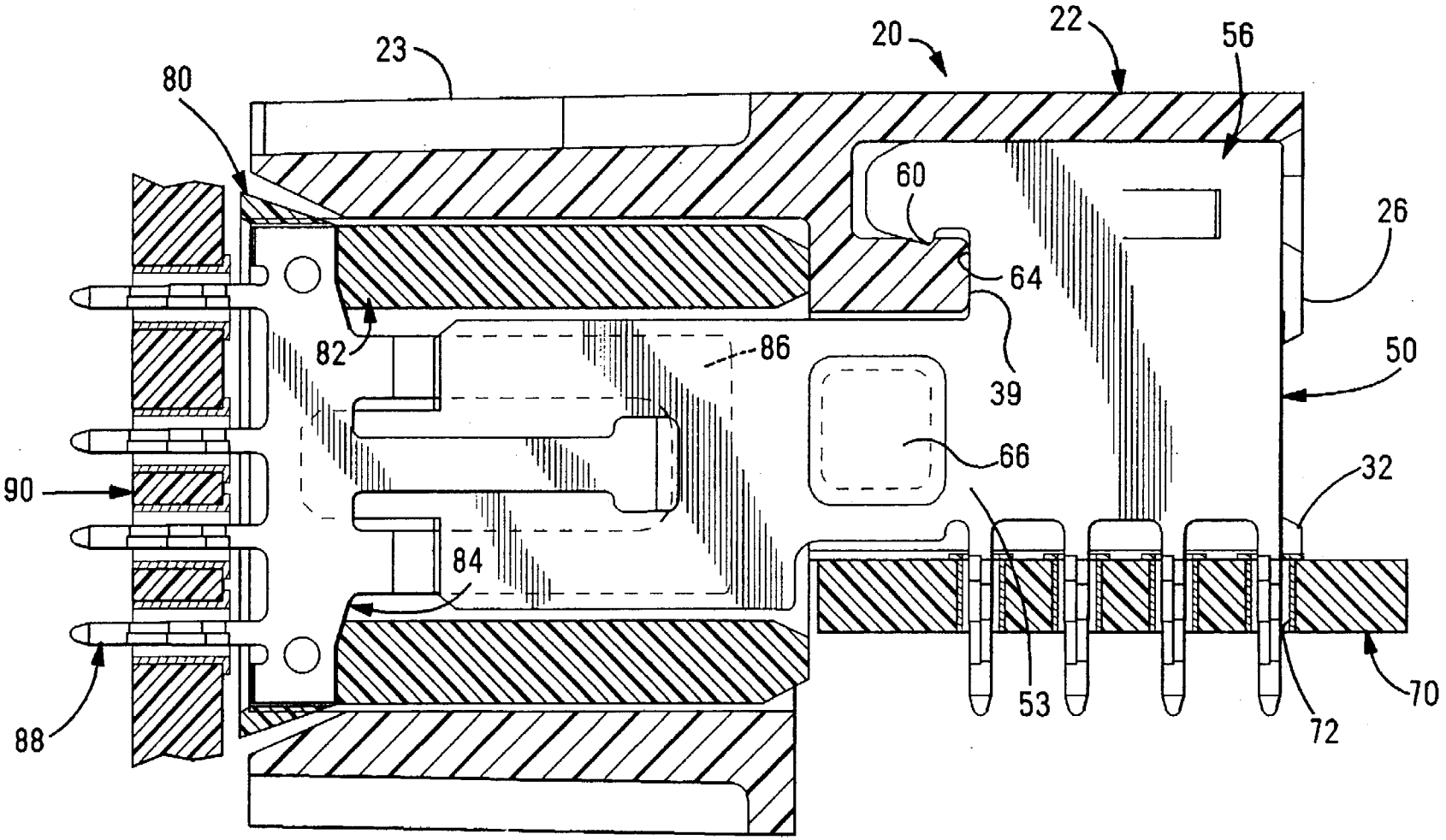
FIG. 8 is a sectional view of a mated connector assembly having the connector of the present invention mated to a complementary connector.

In the preferred embodiment retention section 56 of the contact 50 further includes an outwardly directed lance 62, which extends outwardly in the same direction as embossment 66 and is received in contact-positioning channel portion 42. The contact-positioning channel 42 is adapted to receive the outwardly extending lance 62 of the contact 50 and as shown in FIGS. 5, 6 and 7. The lance 42 and embossment 66 assure that the planar surface of contact 50 is held securely against inner wall 31 of passageway 30 thereby securely positioning contact 50 within passageway 30 and preventing contact 50 from moving sideways in passageway 30, thus keeping the first connecting portion 52 in alignment for mating with complementary contacts 84 in complementary connector 80, as seen in FIG. 8. As shown in FIG. 5 contact 50 is retained and positioned within the respective contact-receiving passageway 30 and is substantially "hung" or suspended from contact-retention channel 36 by the retention portion 56 with the second connecting portion 54, with the plurality of contact tails extending outwardly of the housing 22 through the slot 32.

FIG. 5 shows the assembly face of a connector adapted to receive three contacts of the type 50, one of contact-receiving passageways 30 having a contact 50 disposed therein. FIGS. 6 and 7 are sectional views illustrating channel 36, and contact-positioning channel 42 and the positions of the contact-retention section 58 in channel 36 and lance 62 in contact-positioning channel 42. These figures further show one contact 50 forced against the sidewall 31 of contact-receiving passageway 30 to stabilize the position of the contact 50 within the housing 22.

FIG. 8 is a sectional view of connector 20 and one contact 50 secured in housing 22 with the four contact tails of second connecting portion 54 engaged in and respective through holes 72 of circuit board 70. As can be seen from FIG. 8 the forward portion of housing 22 defines a shroud 23 for receiving the mating connector 80, a portion of the shroud 23 extending beyond and below the circuit board 70. Mating connector 80 is mounted to circuit board 90 via a plurality of contact tails.

Figure 9:
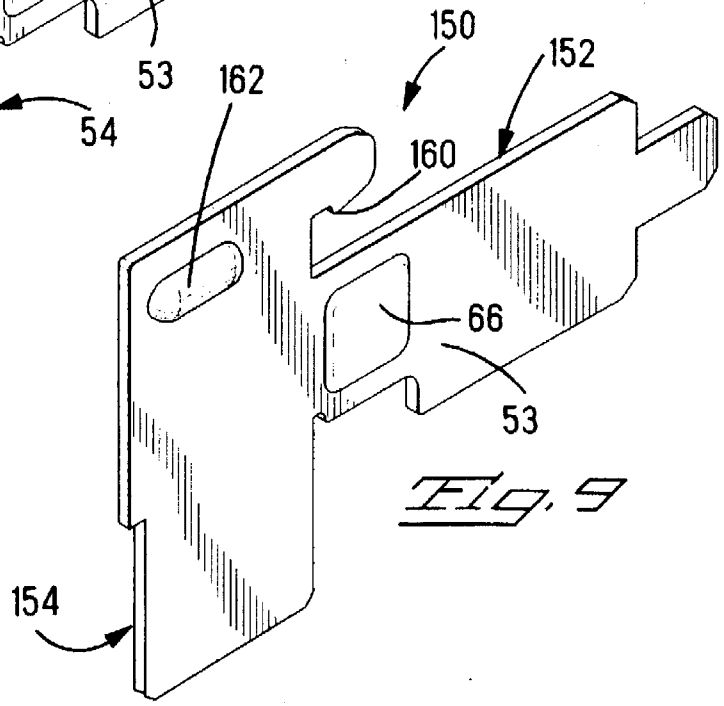
FIG. 9 is a perspective view of an alternative embodiment of the contact made in accordance with the present invention.

FIG. 9 is an alternative embodiment 150 of the contact made in accordance with the invention in which the second connecting portion 154 is a tabular like member which is received into contact-receiving slot 32 upon assembly to the housing 22. Contact 150 includes an embossment 66 on the contact body 153, and a barb 160 and an outwardly directed embossment 162 on the retention section, which are received in the housing passageway 30 and channel 36 in the same manner as embossment and barb 60 and lance 62 respectively, 66 and help to stabilize first connecting portion 152 of the contact 150 in the same manner as previously described.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. A right angle electrical connector comprising:

a housing having a mating face adapted to mate with a complementary electrical connector, an assembly face adapted to receive at least one electrical contact therein, said assembly face being opposed from said mating face, a third face adapted for establishing electrical connection with a complementary electrical article, said third face being at right angles to said mating face, said housing including at least one contact-receiving passageway extending from said assembly face to said mating face, said passageway having a contact-receiving slot open to said third face and to said assembly face;

an electrical contact disposed in an associated one of said at least one housing passageway, each said contact having a first connecting portion exposed at said mating face for electrical engagement with said complementary connector and a second connecting portion extending from said third face and outwardly from said housing for electrical connection to said electrical article, said second connecting portion being at right angles to said first connecting portion, and a retention section remote from and opposite said second connecting portion and associated with a cooperable housing portion thereat;

said cooperable housing portion being opposite from said third face and defining a channel extending forwardly from said assembly face toward said mating face and in communication with said slot, said channel having a width corresponding generally with the thickness of said contact so that said channel is adapted to receive said retention section thereinto upon receiving said contact from said assembly face of said housing;

said contact retention section having a barb at a leading end thereof receivable in a forward end of said channel with said barb dimensioned to create an interference fit with said forward channel portion when said contact is assembled into said housing to resist rearward movement of said contact after full assembly of said contact into said housing.

2. The connector of claim 1 wherein said contact retention section of said contact includes a lance directed outwardly from a surface thereof, said lance being received in a contact-positioning channel of said housing.

3. The connector of claim 1 wherein said contact retention section of said contact includes an embossment directed outwardly from a surface thereof, said embossment being received in a contact-positioning channel of said housing.

4. The connector of claim 1 wherein said contact has a thickness and said contact-receiving passageway has a width greater than the thickness of said contact, and wherein said contact further includes an intermediate body portion having an outwardly directed protrusion which is received in a forward end of said contact-receiving passageway in an interference fit to hold said first connecting portion in alignment at said mating face.

5. The connector of claim 4 wherein said contact retention section of said contact includes a lance directed outwardly from a surface thereof in the same direction as said protrusion of said contact body, said lance being received in a contact-positioning channel of said housing.

6. The connector of claim 4 wherein said contact retention section of said contact includes an embossment directed outwardly from a surface thereof in the same direction as said protrusion of said contact body, said embossment being received in a contact-positioning channel of said housing.

* * * * *